US008988898B2

(12) United States Patent
Villarreal et al.

(10) Patent No.: US 8,988,898 B2
(45) Date of Patent: Mar. 24, 2015

(54) POWER CABLE HAVING SECURITY FEATURE

(75) Inventors: Cesar Lozano Villarreal, Sunnyvale, CA (US); Daniele De Iuliis, San Francisco, CA (US); Matthew Dean Rohrbach, San Francisco, CA (US); James Smeenge, Los Gatos, CA (US); Vicki Spielmann, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 483 days.

(21) Appl. No.: 13/100,260

(22) Filed: May 3, 2011

(65) Prior Publication Data

US 2012/0279780 A1 Nov. 8, 2012

(51) Int. Cl.
*H01B 7/00* (2006.01)
*G08B 13/14* (2006.01)

(52) U.S. Cl.
CPC ..... *G08B 13/1445* (2013.01); *G08B 13/1409* (2013.01)
USPC ..... 361/826; 361/827; 174/36; 174/110 R; 174/113 R; 174/71 R; 174/74 R

(58) Field of Classification Search
CPC . G08B 13/1445; G08B 13/1409; H01R 11/01
USPC ..... 361/826; 174/36, 110 R, 113 R, 74 R, 174/17.08, 72 A, 71 R; 340/568.1, 568.2
See application file for complete search history.

(56) References Cited

U.S. PATENT DOCUMENTS

| | | | | |
|---|---|---|---|---|
| 7,560,828 | B2 * | 7/2009 | Fondriest | 307/9.1 |
| 7,621,753 | B1 * | 11/2009 | Pai | 439/63 |
| 2006/0077057 | A1 * | 4/2006 | Kelsch et al. | 340/568.1 |
| 2006/0196206 | A1 * | 9/2006 | Murray et al. | 62/248 |
| 2007/0152819 | A1 * | 7/2007 | Marszalek et al. | 340/568.4 |

FOREIGN PATENT DOCUMENTS

JP 2009020557 * 1/2009

* cited by examiner

*Primary Examiner* — Jayprakash Gandhi
*Assistant Examiner* — Mukund G Patel
(74) *Attorney, Agent, or Firm* — Kilpatrick Townsend & Stockton LLP

(57) ABSTRACT

Apparatus that may help identify unauthorized removal of goods while maintaining a pleasing physical appearance, avoiding theft misidentifications, and allowing a high degree of customer interaction. One example may provide a signal path for conveying a signal that is active when a good or device is removed from a retail or other environment in an authorized manner. The signal path may be wired or wireless. In another example, a signal path for a sensor may be inconspicuously combined with a power cable. In another example, theft misidentifications may be prevented by not relying on connections that a customer is likely to interact with to detect a theft. Another example may provide a security device that may allow a high degree of customer interaction by unobtrusively attaching a sensor to the back of a good to be protected.

24 Claims, 8 Drawing Sheets

POWER CABLE HAVING SECURITY FEATURE

BACKGROUND

Despite the growing popularity of web-based commerce, in-person retail experiences remain an important part of many people's decisions when purchasing electronic products. This is particularly true for products that provide a high-quality user experience. These products that have a sophisticated look and feel are best shown in person, where customers can interact with them, as opposed to simple on-line images.

Since quality products are best shown in person, it may be desirable that customers have full access to them in the retail environment. For example, it may be desirable to allow customers to play with keyboards, monitors, and power plugs on such devices as laptop and netbook computers.

Unfortunately, there is a downside in allowing customers such unfettered access to these high-quality products. On occasion, the products may be stolen. For this reason, it is desirable to be able to detect when a device is being removed from a retail environment in an unauthorized manner. Once an attempt at such an unauthorized removal is detected, steps can be initiated to stop the removal, to prevent other such removals, or to attempt to recover the removed devices at that or a later time.

But it is also desirable to avoid "false alarms." That is, it may be desirable to avoid misidentifying mere customer activity and exploration as attempted theft. For example, it may be undesirable for an alarm to sound when a customer merely types on a keyboard or plays with a power connector. Such misidentification can embarrass customers, cause confusion, and create an unprofessional appearing environment, which may lead to customer dissatisfaction, reduced reputation, and a corresponding drop in sales.

It may also be desirable to avoid product-loss counter measures that visually clutter or complicate a user's experience. For example, bolting a laptop, or tethering it using a thick cable, may prevent removal of the laptop, but may also inhibit a user from interacting with the device and provide an unpleasing appearance.

Thus, what is needed are apparatus that help identify unauthorized removal of goods while maintaining a pleasing physical appearance, avoiding misidentifications, and allowing a high degree of customer interaction.

SUMMARY

Accordingly, embodiments of the present invention provide apparatus that may help identify unauthorized removal of goods while maintaining a pleasing physical appearance, avoiding misidentifications, and allowing a high degree of customer interaction.

An exemplary embodiment of the present invention may provide a signal path for conveying a signal that is active when a good or device is removed from a retail or other environment in an authorized manner. In a specific embodiment of the present invention, the signal path may be over a pair of wires connected to a sensor. The sensor may be attached by adhesive or otherwise affixed to a good to be protected. When the sensor is attached to the good, a pin may be depressed, thereby closing a switch and connecting the wires together. When the sensor is removed, or the wire path cut, the wires may be disconnected. This disconnect may be sensed as an attempt to remove the good in an unauthorized manner.

In another specific embodiment of the present invention, the signal path may be a wireless path where the sensor may include a transmitter and may be attached by adhesive or otherwise affixed to a good to be protected. When the sensor is attached to the good, a pin may be depressed, thereby closing a switch and activating a transmitter. When the good and the attached sensor are moved a certain distance away, reception may be lost and an authorized removal attempt may be detected. When the sensor is removed, the transmitter may be deactivated and an authorized removal attempt may be detected.

Another exemplary embodiment of the present invention may provide a security device that may provide a desirable physical appearance. In a specific embodiment of the present invention, a signal path for a sensor may be inconspicuously combined with a power cable. In one example, the signal path may be combined with a power cable up to a power plug. Only a segment of the signal path from the power plug to a sensor may be visible to a user. In another specific embodiment of the present invention, the signal path may be wireless, and this segment may not be needed. These and other configurations provided by embodiments of the present invention may provide a pleasing appearance and allow a user to remove the power plug without activating the sensor, while still providing notification of an authorized removal.

Another exemplary embodiment of the present invention may provide a security device that helps avoid misidentification of an attempted theft. In a specific embodiment of the present invention, misidentifications may be prevented by not relying on connections that a customer is likely to interact with to detect a theft. In one example, a sensor may be separate from a power plug. This may allow a user to remove the power plug for inspection without triggering a false alarm. This may be particularly useful where the plug is interesting, for example, where the plug and receptacle are magnetically attracted to each other.

Another exemplary embodiment of the present invention may provide a security device that may allow a high degree of customer interaction. In a specific embodiment of the present invention, a sensor may be unobtrusively attached to the back of the device. For example, where the device is a laptop or netbook computer, the sensor may be attached to the back of a display. This may allow a user to play with a keyboard, remove a power connection, and otherwise interact with the device while security measures remain in place.

While embodiments of the present invention are particularly suited to securing laptop or netbook computers, other devices, such as portable computing devices, tablet, desktop, and all-in-one computers, cell, smart, and media phones, storage devices, portable media players, navigation systems, monitors, and others, may be secured using embodiments of the present invention.

Various embodiments of the present invention may incorporate one or more of these and the other features described herein. A better understanding of the nature and advantages of the present invention may be gained by reference to the following detailed description and the accompanying drawings.

BRIEF DESCRIPTION OF THE DRAWINGS

FIG. 4A illustrates an exemplary wiring for a cable apparatus according to an embodiment of the present invention, while

DESCRIPTION OF EXEMPLARY EMBODIMENTS

Figure 1:
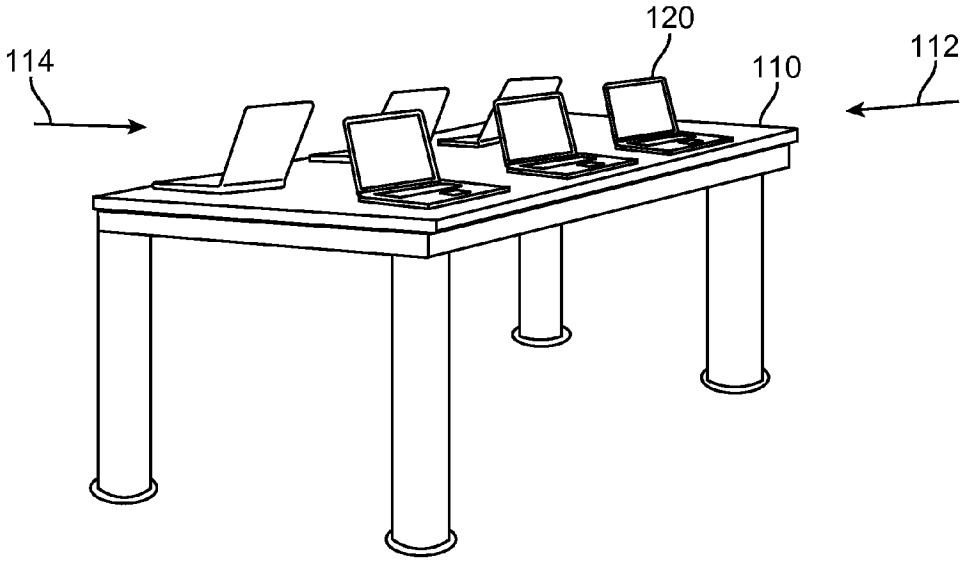
FIG. 1 illustrates a portion of a retail environment that may be improved by the incorporation of embodiments of the present invention.

FIG. 1 illustrates a portion of a retail environment that may be improved by the incorporation of embodiments of the present invention. This figure illustrates a display table 110 on which a number of laptop computers 120 may be arranged. Having laptops 120 arranged in this manner may allow users to access and interact with laptops 120 from directions 112 and 114.

Again, it may be desirable to allow customers to be able to fully interact with laptops 120. That is, it may be desirable to allow customers to pick up a laptop 120, play with its keyboard, adjust its display, examine its power connector, and interact with it in other ways. Unfortunately, on occasion, an unauthorized removal of a laptop 120 may be attempted. That is, someone may try to steal one or more of the laptops 120. Accordingly, embodiments of the present invention provide apparatus that may help in avoiding such unauthorized removal.

Again, it may be desirable to provide a pleasant retail environment. Moreover, it may be desirable to avoid false alarms, or incorrect indications of an attempted theft. Such false alarms may confuse or annoy shoppers, and provide an unprofessional appearance. Accordingly, embodiments of the present invention further provide apparatus that may have an aesthetically pleasing appearance and may avoid false alarms. An example of one such apparatus is shown in the following figure.

Figure 2:
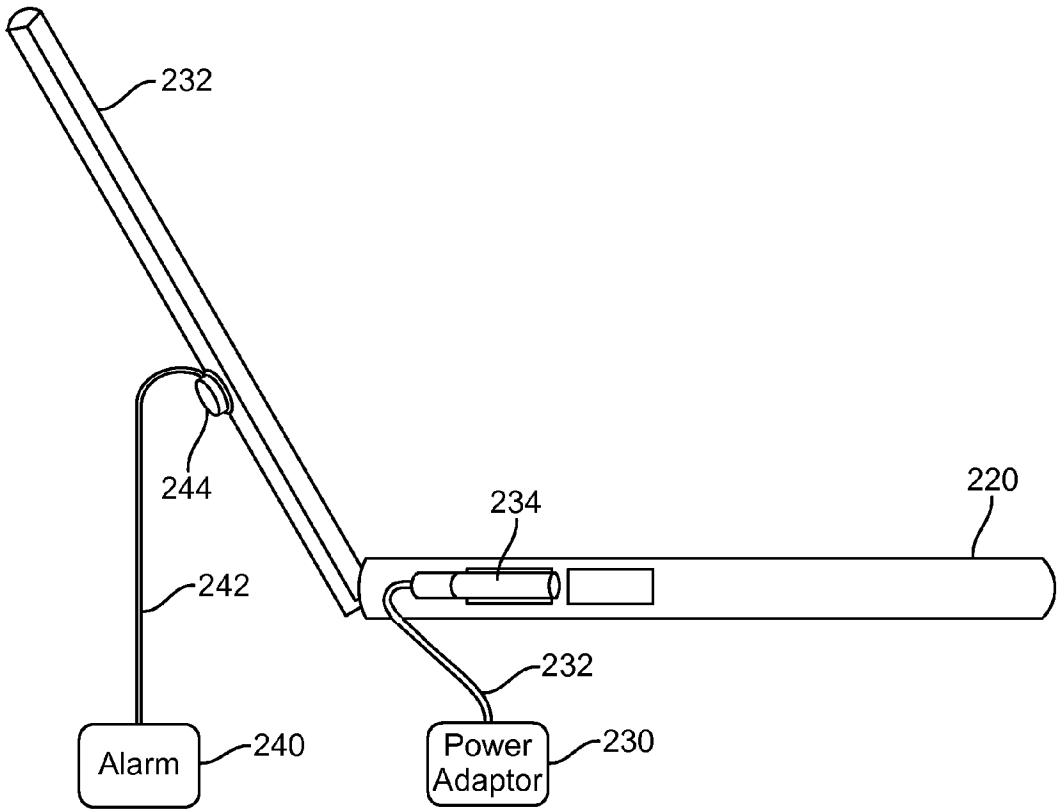
FIG. 2 illustrates a theft prevention cable apparatus according to an embodiment of the present invention.

FIG. 2 illustrates a theft prevention cable apparatus according to an embodiment of the present invention. This figure, as with the other included figures, is shown for illustrative purposes and does not limit either the possible embodiments of the present invention or the claims. It should also be noted that the same or similarly numbered or named features may be the same features in each of the drawings, for example, connectors 420 and 520 may be the same or similar connector.

In this example, laptop 220 may be powered via power adapter 230 and may be protected by alarm 240. Power adapter 230 may provide power to laptop 220 via cable 232 and power connector 234. Alarm 240 may be connected to sensor 244 through cable 242.

Again, power adapter 230 may provide power to laptop 220. Power adapter 230 may be a power adapter that provides power to several laptops 220. Power adapter 230 may be integrated or housed with other electronic circuitry, such as alarm 240 or other power supply circuitry. Power adapter 230 may convert AC power to DC power that may be used by computer 220. Power adapter 230 may provide power to laptop 220 using power connector 234, which may be a magnetic or other type of connector.

Sensor 244 may be attached to a back of display 222 of laptop 220. In this way, sensor 244 may remain unobtrusive and out of view of a user, though sensor 244 may be located on or inside other parts of laptop 220. Sensor 244 may connect to alarm 240 via cable 242. If cable 242 is cut, alarm 240 may sense this and signal that an unauthorized removal may be taking place. Also, if sensor 244 is removed from laptop 220, sensor 244 may detect this and signal that an unauthorized removal may be taking place.

Specifically, sensor 244 may be held in place with an adhesive layer, magnets, or other appropriate manner. While sensor 244 is held in place, a spring-biased pin (not shown) may be depressed closing a switch (not shown) in sensor 244. When sensor 244 is removed, this pin may be released, thereby opening the switch. This opening may be detected by alarm 240, which may indicate that an unauthorized removal may be occurring.

Alarm 240 may be a dedicated alarm, or may be an alarm that is integrated in the functionality of a computer, server, or other electronic device.

In this embodiment of the present invention, two cables, specifically cables 232 and 242, are needed. Accordingly, another embodiment of the present invention combines these cables along part of their length to provide a cable apparatus having an aesthetically pleasing appearance. An example is shown in the following figure.

Figure 3:
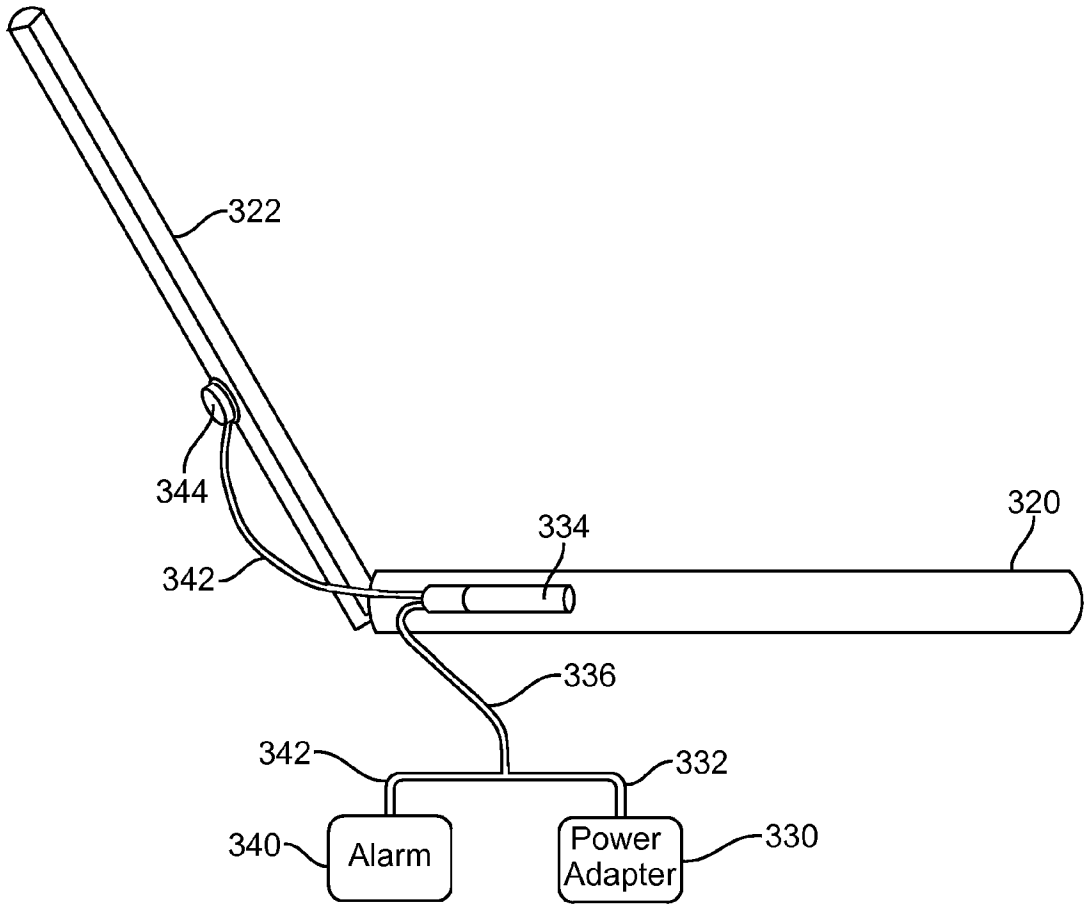
FIG. 3 illustrates a cable apparatus according to an embodiment of the present invention.

FIG. 3 illustrates a cable apparatus according to an embodiment of the present invention. In this example, power adapter 330 may provide power through cable 332. Cable 332 may then be routed inside cable 336 to power connector 334. Power connector 334 may provide power to laptop 320. Alarm 340 may be connected to cable 342. Cable 342 may be routed through cable 336 and through housing 334, where it may emerge and connect to sensor 344 on a back of display 322 on laptop 320.

In this way, cables 332 and 342 appear to a customer as a single cable 336 up to power connector 334. Cable 342 may emerge from power connector 334 and connect to sensor 344, as before. If cables 342 or 336 are cut, alarm 340 may indicate that a theft may be occurring. Similarly, if sensor 344 is removed, alarm 340 may indicate that a theft may be occurring.

In various embodiments of the present invention, alarm 340 may provide various indications that a theft is occurring. For example, a loud sound may be generated by, or caused to be generated by, alarm 340. In other embodiments of the present invention, alarm 340 may send, or cause to be sent, an email, text, or other message. Alarm 340 may provide an indication in the form of a light, sound, or other mechanism to a sales desk, security station, or other personnel or location.

By employing a cable apparatus consistent with an embodiment of the present invention, such as the cable apparatus in FIG. 3, a user may be able to engage laptop 320. For example, a user may be able to interact with its keyboard (not shown) and display 322 without a theft being indicated. Also, a user may be able to remove and inspect power connector 334 without a theft being indicated. A pleasing appearance may be maintained by reducing the number of cables routed to laptop 320. An example of wiring that may be used for a cable apparatus according to an embodiment of the present invention is shown in the following figure.

Figure 4A:
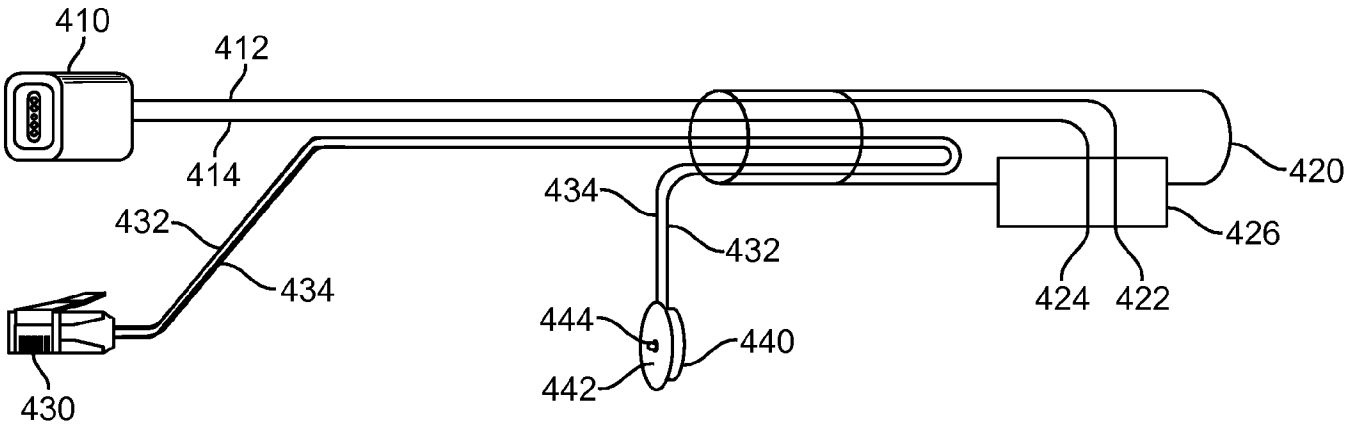

FIG. 4A illustrates an exemplary wiring for a cable apparatus 400 according to an embodiment of the present invention. In this example, a power connector 410 may receive power from a power adapter. This received power may include a positive power supply and a ground, a positive power supply and a negative power supply, a ground and a negative power supply, or any combination thereof. This power may be provided on wires 412 and 414 to power connector 420. These wires may connect to contacts, such as 422 and 424, in connector 420. Connector 420 may be a magnetic or other type of power connector. For example, power connector 420 may include attraction plate 426 that may be magnetically attracted to one or more magnets in a corresponding connector receptacle in a laptop, tablet, netbook, or other type of computer or other electronic device. In various embodiments of the present invention, connector 420 may be a MagSafe™ connector.

Cable apparatus 400 may also include connector 430 for connecting to an alarm. Connector 430 may be an RJ-11 or other type of connector. Connector 430 may connect to wires 432 and 434. Wires 432 and 434 may be routed through power connector 420. For example, wires 432 and 434 may be routed through power connector 420 such that they do not interact with circuitry or other component in power connector 420. Wires 432 and 434 may connect to sensor 440. Sensor 440 may include a face 442, which may be covered with an adhesive layer for attaching to a laptop or other electronic device. Sensor 440 may also include a pin 444. When sensor 440 is attached to an electronic device, pin 444 may be depressed, thereby closing a switch. If one or both wires 432 or 434 are cut, or pin 444 is not depressed, an alarm may detect an opening between wires 432 and 434, and may indicate that a theft may be occurring. When wires 432 and 434 are intact and pin 444 is depressed, an alarm may sense a short between wires 432 and 434 and may not indicate that a theft may be occurring. In this example, wires 432 and 434 may be a first wire and a second wire, while wires 412 and 414 may be a third wire and a fourth wire. A more detailed view of the sensor is shown in the following figure.

Figure 4B:
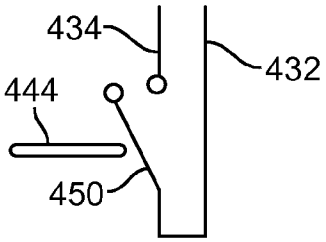
FIG. 4B illustrates a more detailed view of a sensor portion of a cable apparatus according to an embodiment of the present invention.

FIG. 4B illustrates a more detailed view of a sensor according to an embodiment of the present invention. Sensor 440 may be used as the sensor in this and the other included examples. In this example, pin 444 may be spring-biased to be in an "out" or non-depressed position unless it is actively depressed, for example when sensor 440 is attached to a device to be protected.

Again, when sensor face 442 is attached to a device to be protected, pin 444 may be depressed. This action closes switch 450, thereby shorting wires 432 and 434 together. An alarm may sense a short between these wires and may not provide an indication that a theft is taking place. Conversely, when sensor 440 is removed, pin 444 may be biased to the out position and switch 450 may be open. When this occurs, or when one or both of the wires 432 or 434 are cut, an alarm may sense an open circuit between wires 432 or 434 and provide an indication that a theft is taking place.

In one example, as wires 412 and 414 emerge from power connector 410, they may be clad in a jacket or insulating layer as a single cable. Similarly, as wires 432 and 434 emerge from connector 430, they may be clad in a jacket or insulating layer as a separate cable. At some point, these cables may join as a single cable and be routed to power connector 420. Wires 432 and 434 may emerge from power connector 420 clad in a jacket or insulating layer as another separate cable portion. An example of this is shown in the following figure.

Figure 5:
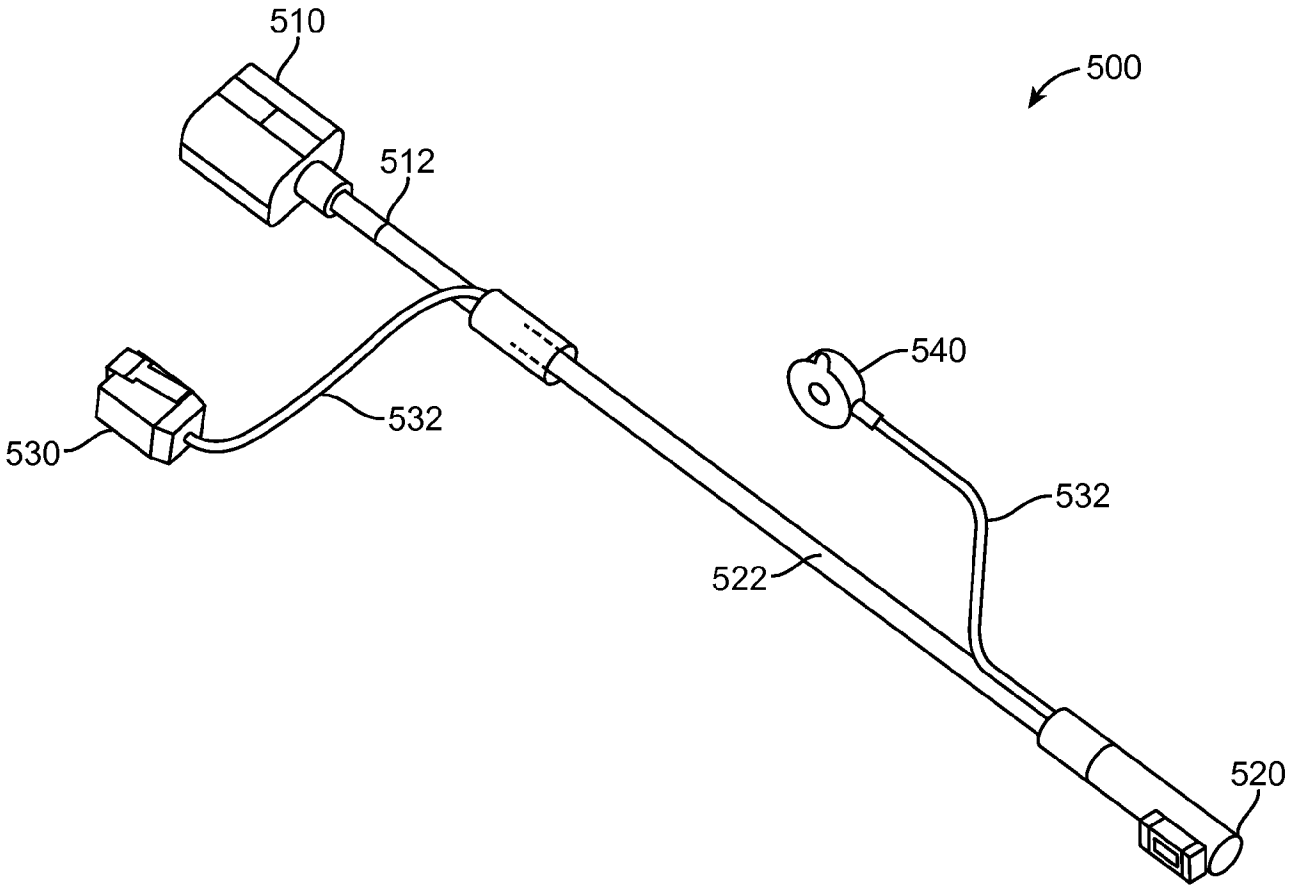
FIG. 5 illustrates a cable apparatus according to an embodiment of the present invention.

FIG. 5 illustrates a cable apparatus 500 according to an embodiment of the present invention. This figure illustrates a power connector 510 that may provide power over cable 512 to power connector 520. Power connector 520 may be arranged to mate with a connector receptacle in a laptop, tablet, netbook, or other electronic or other device. Connector 530, which may be arranged to connect to an alarm, may be connected to sensor 540 via cable 532. Cables 532 and 512 may be combined as a single cable 522 for a portion of their lengths.

In one embodiment of the present invention, circuitry for an alarm and power adapter may be combined in a single unit. An example is shown in the following figure.

Figure 6:
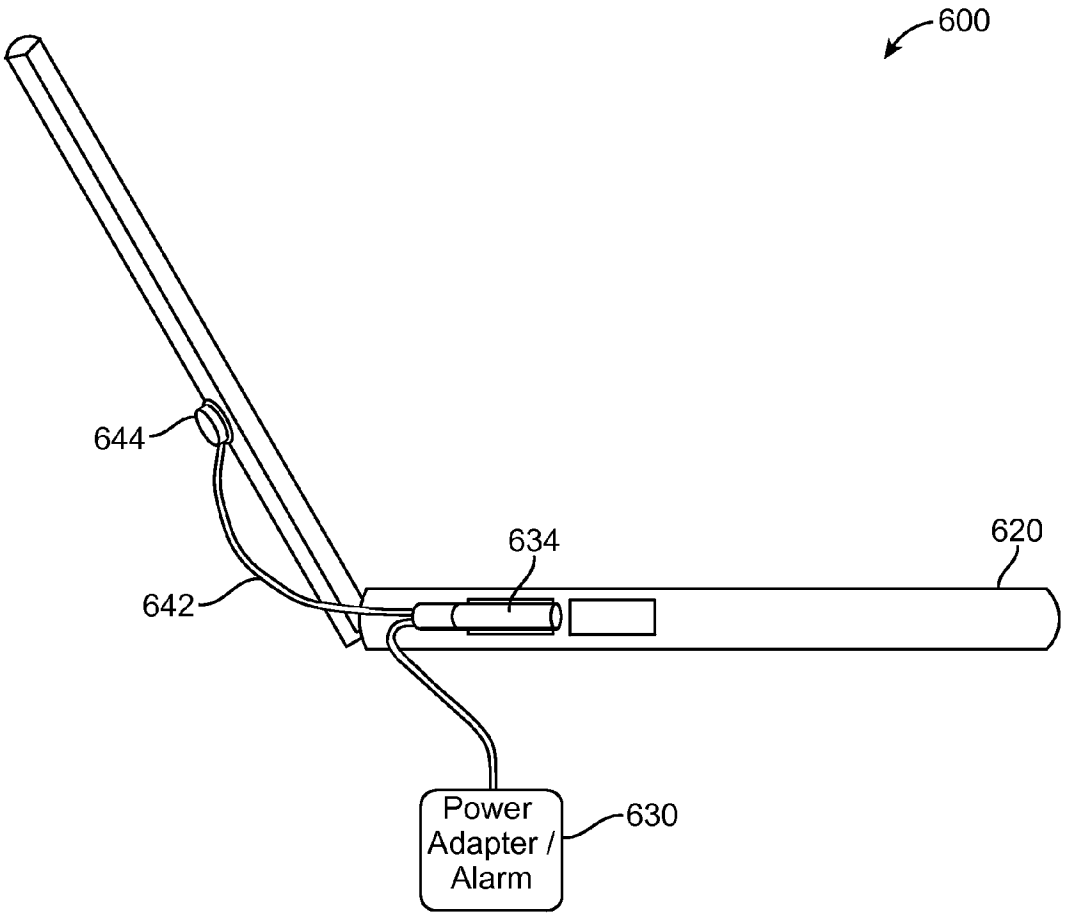
FIG. 6 illustrates a cable apparatus according to an embodiment of the present invention.

FIG. 6 illustrates a cable apparatus according to an embodiment of the present invention. In this example, a combined power adapter and alarm 630 may connect to power connector 634, which may be attached to laptop 620. Power adapter and alarm 630 may connect to sensor 644 via cable 642.

In another embodiment of the present invention, a cable connecting to a sensor may not be routed through a power connector. An example is shown in the following figure.

Figure 7:
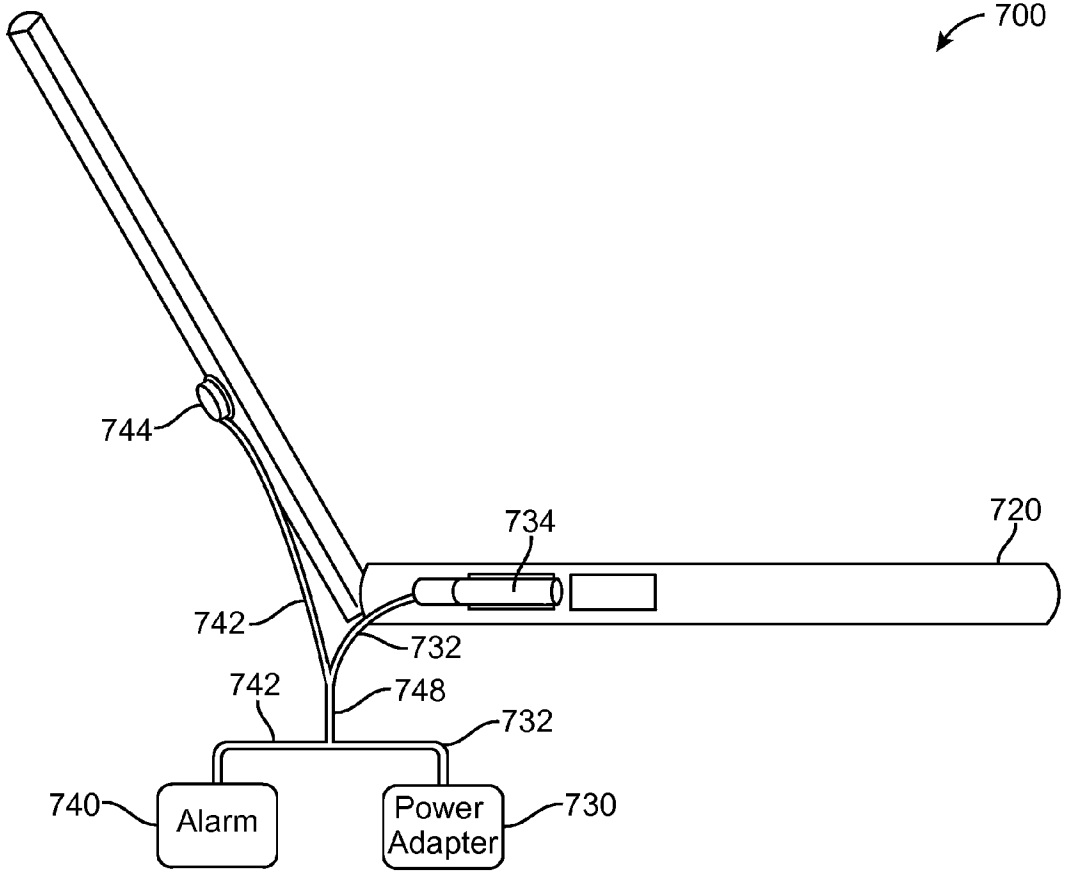
FIG. 7 illustrates a cable apparatus according to an embodiment of the present invention.

FIG. 7 illustrates a cable apparatus according to an embodiment of the present invention. In this example, power adapter 730 may provide power over cable 732 to power connector 734, which may provide power to laptop 720. Alarm 740 may connect to sensor 744 through cable 742. Cables 730 and 742 may be joined as a single cable for part of their length, shown here as cable portion 748.

In other embodiments of the present invention, a sensor may be wireless. This may eliminate the need for a separate cable to the sensor. An example is shown in the following figure.

Figure 8:
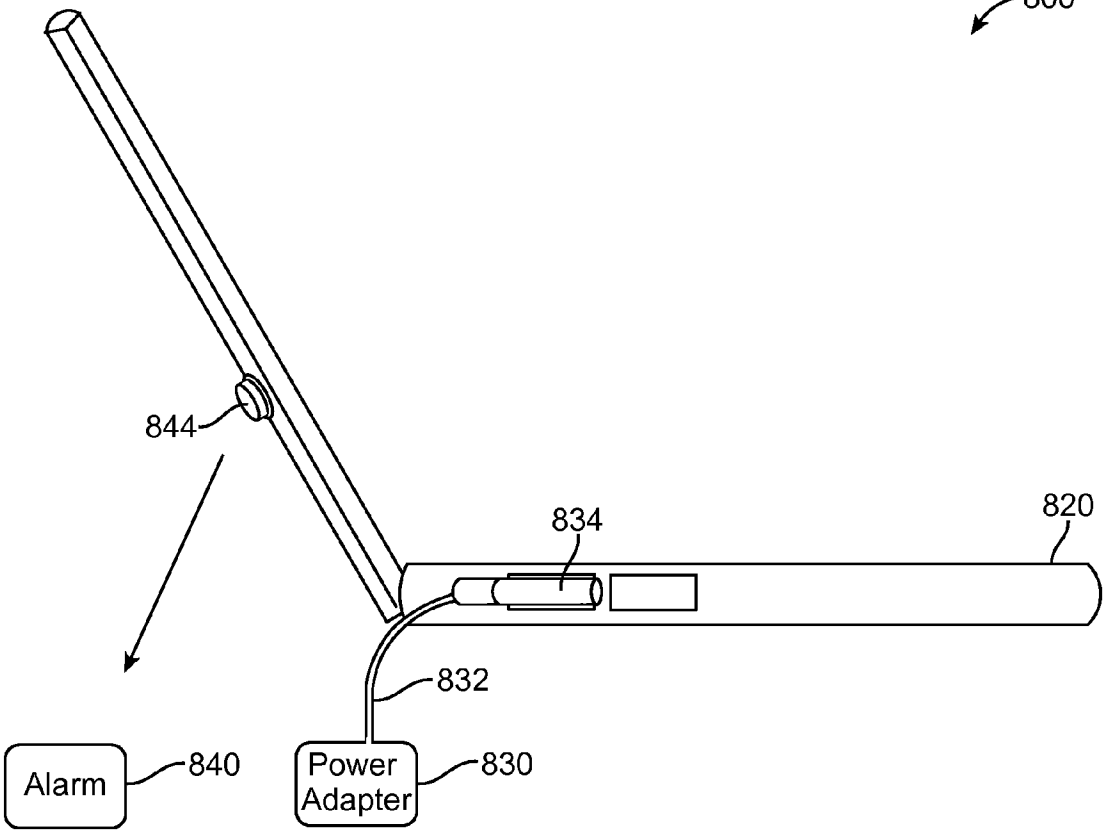
FIG. 8 illustrates a cable and wireless apparatus according to an embodiment of the present invention.

FIG. 8 illustrates a cable and wireless apparatus according to an embodiment of the present invention. In this example, power adapter 830 may provide power to laptop 820 via cable 832 and power connector 834. Sensor 844 may communicate wirelessly with alarm 840. During normal operation, sensor 844 may actively send a wireless signal to alarm 840. So long as alarm 840 continues to receive this signal, alarm 840 may not indicate that an authorized removal may be taking place. As sensor 844 is moved out of range from alarm 840, alarm 840 may indicate that an unauthorized removal is occurring. Similarly, if sensor 844 is removed from laptop 820, sensor 844 may shut off transmissions, or provide another indication of its removal, and alarm 840 may indicate that a theft may be taking place. Sensor 844 may be attached to laptop 820, or sensor 844 may be integrated inside laptop 820.

While these and other embodiments of the present invention are well-suited for a retail environment, they are also well-suited for other environments. For example, in education or public access environments, it may be desirable to allow users to interact with laptops or other electronic devices while providing an indication of an unauthorized removal. As one example, a laptop may be used in an office. If an unauthorized removal occurs, an alarm or other notification, such as an email or text message, may be sent. Alternatively, personnel at a front desk or security station may be alerted, and they may be able to prevent or mitigate a theft.

Also, while embodiments of the present invention are well-suited for protecting laptop, tablet, or netbook computers, other types of electronic devices, such as portable computing devices, desktop and all-in-one computers, cell, smart, and media phones, storage devices, portable media players, navigation systems, monitors, and others, may be protected. Also, other goods may be protected using embodiments of the present invention, such as conventional or electronic bicycles or other transportation, or other goods or materials.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

Thus, it will be appreciated that the invention is intended to cover all modifications and equivalents within the scope of the following claims.

What is claimed is:

1. A cable apparatus comprising:

a sensor coupled to a first wire and a second wire;

a first connector coupled to the first wire and the second wire;

a first power connector connected to a third wire and a fourth wire; and a second power connector connected to the third wire and the fourth wire and having a first opening to receive the first wire, the second wire, the third wire, and the fourth wire, wherein the first, second, third, and fourth wire are surrounded by a first insulative jacket near the second power connector, and the first and second wires are surrounded by a second insulative jacket from the second power connector to the sensor, and the first wire and the second wire enter and exit the first opening of the second connector.

2. The cable apparatus of claim 1 wherein the sensor comprises a switch.

3. The cable apparatus of claim 2 wherein the sensor comprises an adhesive layer for attaching to a device.

4. The cable apparatus of claim 3 wherein the sensor further comprises a pin arranged to be depressed when the sensor is attached to the device.

5. The cable apparatus of claim 4 wherein when the pin is depressed, the switch is closed and the first wire is connected to the second wire.

6. The cable apparatus of claim 1 wherein the first connector is an RJ-11 connector.

7. The cable apparatus of claim 1 wherein the second power connector is a magnetic power connector.

8. The cable apparatus of claim 1 wherein the second power connector is magnetic power connector for a laptop computer.

9. The cable apparatus of claim 1 wherein the first wire and the second wire enter and exit the first opening of the second connector without electrically contacting the second connector.

10. A cable apparatus comprising:

a first plurality of conductors to provide power;

a first connector coupled to a first end of the first plurality of conductors;

a second connector having a first opening to receive a second end of the first plurality of conductors;

a second plurality of conductors for conveying a signal;

a third connector coupled to a first end of the second plurality of conductors; and a sensor coupled to a second end of the second plurality of conductors;

wherein the second plurality of conductors enter and exit the first opening of the second connector, and the second plurality of conductors are encased in a jacket from the third connector to the sensor.

11. The cable apparatus of claim 10 wherein the sensor further comprises an adhesive layer to attach the sensor to an electronic device.

12. The cable apparatus of claim 11 wherein when the sensor is attached to the electronic device, a switch is closed connecting a first wire in the second plurality of wires to a second wire in the second plurality of wires.

13. The cable apparatus of claim 12 wherein when the sensor is removed from the electronic device, a switch is opened disconnecting the first wire in the second plurality of wires from the second wire in the second plurality of wires.

14. The cable apparatus of claim 13 wherein the sensor further comprises a pin, wherein when the sensor is attached to the device, the pin is depressed and the switch is closed.

15. The cable apparatus of claim 10 wherein the first plurality of conductors comprises a first wire for conveying a power supply and a second wire for conveying a ground.

16. The cable apparatus of claim 10 wherein the second connector is a plug in a magnetic connector system.

17. The cable apparatus of claim 10 wherein the second plurality of conductors enter and exit the first opening of the second connector without electrically contacting the second connector.

18. A cable apparatus comprising:

a first connector;

a first cable portion comprising a first plurality of conductors and a first insulative jacket around the first plurality of conductors, the first cable portion extending to a first opening of the first connector;

a second connector;

a sensor;

a second cable portion comprising a second plurality of conductors and a second insulative jacket around the second plurality of conductors, the second cable portion extending from the second connector to the sensor; and a third insulating layer around the first cable portion and the second cable portion for a first length terminating at the first connector;

wherein the second cable portion enters and exits the first connector at the first opening.

19. The cable apparatus of claim 18 wherein the first connector is a plug in a magnetic connector system.

20. The cable apparatus of claim 19 further comprising a third connector, wherein the first cable portion extends from the third connector to the first connector.

21. The cable apparatus of claim 19 wherein the first cable portion extends from the second connector to the first connector.

22. The cable apparatus of claim 18 wherein the second cable portion enters and exits the first opening of the second connector without electrically contacting the second connector.

23. A cable apparatus comprising:

a first connector coupled to first ends of a first wire and a second wire;

a sensor coupled to second ends of the first wire and the second wire;

a first power connector coupled to first ends of a first power conductor and a second power conductor; and a second power connector coupled to second ends of the first power conductor and the second power conductor, the second power connector having a first opening to receive the first wire, the second wire, the first power conductor, and the second power conductor, the second power connector further having a second opening for a first contact and a second contact, the first contact electrically connected to the first power conductor and the second contact electrically connected to the second power conductor;

wherein the first wire and the second wire enter and exit the first opening of the second connector, and the first wire and the second wire are encased in a jacket from the second power connector to the sensor.

24. The cable apparatus of claim 23 wherein the first wire and the second wire enter and exit the first opening of the second connector without electrically contacting the second connector.

* * * * *